US007454886B2

(12) United States Patent
Asma

(10) Patent No.: US 7,454,886 B2
(45) Date of Patent: Nov. 25, 2008

(54) MACHINE FOR PACKAGING PRODUCTS

(75) Inventor: Seferinus Jelle Asma, Cm Veldhoven (NL)

(73) Assignee: CFS Weert B.V., Weert (NL)

( * ) Notice: Subject to any disclaimer, the term of this patent is extended or adjusted under 35 U.S.C. 154(b) by 0 days.

(21) Appl. No.: 11/973,365

(22) Filed: Oct. 9, 2007

(65) Prior Publication Data

US 2008/0034715 A1 Feb. 14, 2008

Related U.S. Application Data

(62) Division of application No. 10/511,580, filed on May 6, 2005, application No. PCT/NL03/00295, filed on Apr. 17, 2003, now Pat. No. 7,287,361.

(30) Foreign Application Priority Data

Apr. 18, 2002 (NL) ..... 1020419

(51) Int. Cl.
*B65B 11/00* (2006.01)

(52) U.S. Cl. ..... 53/594; 53/234; 53/370; 53/580

(58) Field of Classification Search ..... 53/594, 53/397, 580, 370, 227, 234
See application file for complete search history.

(56) References Cited

U.S. PATENT DOCUMENTS

| | | | | | |
|---|---|---|---|---|---|
| 2,486,758 | A * | 11/1949 | Pfeiffer | 53/397 |
| 2,872,768 | A * | 2/1959 | Shepler | 53/594 |
| 3,264,115 | A | 8/1966 | Davis | |
| 3,272,152 | A * | 9/1966 | Williams | 425/126.2 |
| 3,899,865 | A * | 8/1975 | Revaz | 53/234 |
| 5,016,421 | A | 5/1991 | Ferrero | |
| 5,241,807 | A | 9/1993 | Quick et al. | |
| 5,450,706 | A | 9/1995 | Latini | |
| 5,519,981 | A | 5/1996 | Fukusaki | |
| 5,775,063 | A * | 7/1998 | Ikai et al. | 53/463 |
| 2003/0192287 | A1 * | 10/2003 | VanAlstine | 53/412 |

FOREIGN PATENT DOCUMENTS

| | | | |
|---|---|---|---|
| EP | 0 036 282 | | 9/1981 |
| EP | 1 041 005 | | 10/2000 |
| GB | 328 145 | | 4/1930 |
| IT | EP1310430 | * | 5/2003 |
| WO | WO 00/21835 | | 4/2000 |

* cited by examiner

*Primary Examiner*—Thanh K Truong
(74) *Attorney, Agent, or Firm*—Young & Thompson

(57) ABSTRACT

Device for packaging products having a head and a stick, such as lollipops (P), in wraps, includes a frame having first supply elements (2) for supplying the products, second elements (4) for supplying a web (5) of wrapping material, elements (101) for cutting a wrap from the web, a wrapping station having a driven series of elements for retaining the products and circulating in a first direction about a horizontal shaft, and a drum (50) driven in the same direction having elements for enveloping the product heads with a wrap and elements for securing the wrap on the products, the wrapping station including a supply station and a discharge station, the second supply elements being positioned for supplying the web of wrapping material according to a path that is tangential to the drum, in a direction running along with the drum rotation.

14 Claims, 9 Drawing Sheets

MACHINE FOR PACKAGING PRODUCTS

CROSS REFERENCE TO RELATED APPLICATION

This is a division of allowed application Ser. No. 10/511,580 filed on May 6, 2005 as the 35 USC 371 national stage of international application PCT/NL03/00295 filed Apr. 17, 2003, which designated the United States of America and claimed priority to Dutch application 1020419 filed on Apr. 18, 2002.

FIELD OF THE INVENTION

The invention relates to a device for packaging products having a head and a stick, such as lollipops, in wraps, particularly in wraps that are arranged to envelop the head, according to the so-called bunch-wrapper system.

BACKGROUND OF THE INVENTION

The wrapping material is supplied web-shaped to a packaging station, where a circulating series of stick retainers are present, as well as a drum circulating along, on which a series of diaphragms and a series of wrappers have been arranged.

The foil is supplied in downward direction in the upper area of the drum, is consecutively cut in separate wraps, the wrap during the cutting being held in front of a diaphragm between the head of a lollipop to be wrapped and an ejector and the retainer being moved towards the diaphragm (the ejector moving along), as a result of which the head of the product with the wrap is pushed through the diaphragm, which takes place during rotation of the drum.

After the head has completely passed through the diaphragm, a wrapper grips the head provided with the wrap and the diaphragm closes behind the head, so that the parts of the wrap situated behind the head are brought against the stick. By heating the diaphragm members the wrap is sealed there. The wrapper here rotates the head. All this takes place during continuous rotation of the drum. The product packaged thus are moved back again with their heads through the diaphragm that has been opened again, after which they are discharged by the retainer at the location of a discharge, and the retainer in question is able to receive a new product for a next cycle.

In the known packaging machine the adjustment in the position and the movement of the foil web on the one hand and the parts rotating along with the drum on the other hand is a subject of concern, particularly when the packaging machine has to be able to operate at high frequencies and there is question of a wrap with a print that has to be arranged exactly on the head of the product. An example is a picture that is situated centrally on the wrap and has to end up exactly at the tip of the head of the product.

It is an object of the invention to improve on this.

SUMMARY OF THE INVENTION

To that end according to the invention a device is provided for packaging products having a head and a stick, such as lollipops, in wraps, comprising a frame including first supply means for supplying the products, second means for supplying a web of wrapping material, means for cutting a wrap from the web, a wrapping station having a driven series of means for retaining the products and circulating in a first direction about a horizontal shaft, and a drum driven in the same direction having means for enveloping the product heads with a wrap and means for securing the wrap on the products, the wrapping station comprising a supply station and a discharge station, the second supply means being positioned for supplying the web of wrapping material according to a path that is tangential to the drum, in a direction running along with the drum rotation.

In the device according to the invention the foil web extends parallel to the tangent at the drum at the location of the cutting of the wraps, while the movement direction there is equal as well. As a result it becomes simpler to obtain a correct adjustment and positioning, as a result of which packaging can take place at higher frequencies, without having to sacrifice the accuracy of the placement of the wraps.

Preferably the second supply means, for supplying the web of wrapping material, are positioned for substantially vertical supply. The retaining means and the drum are preferably driven for carrying out a substantially downward motion at the location of the supply station.

At the location of the supply location, the foil lies aside of the track where heat is generated for closing the wraps by welding. The warm air rising from there does not contact the supplied web of wraps, so that it is not affected by it. During standstill of the drum as a result of failures or change of products, the foil is no longer exposed to the rising warm air for a long time.

An advantage is that less failures are caused by broken pieces of product, particularly sugary parts of lollipops. When there is a lollipop with a crack for instance, it will quite likely subside when transferred to the retainers. For other reasons as well parts of confectionary may be loosened and end up in the rotating parts of the drum. This may hamper the motion of the diaphragms, as a result of which they cannot close and the wrap is not secured to the head of the lollipop. In the device according to the invention parts of lollipops can freely fall down, immediately from the drum downwards, without ending up in the drum-itself, as a result of which the device is much less prone to jamming or bad functioning due to loose parts of confectionery.

Preferably the device is furthermore provided with a discharge station for discharge of packaged products from the retaining means, the discharge station being placed at the location of the upper side of the drum. In this way the upper area of the drum vacated due to the selected supply location is advantageously used. The products are guided upwards in the wrapping process, so that more possibilities are available for the lay-out of the discharge of wrapped products due to the higher upward movement level of the wrapped products. Extra sorting possibilities could for instance be incorporated in the device.

Preferably the second supply means are adapted for continuous supply of the web of wrapping material. As a result the device is less exposed to starting and stopping forces as well as the wrapping material itself, which as a result can be cut and treated further more accurately.

Preferably the second supply means and the means for driving the drum are adjustable to each other for causing the web speed of the web of wrapping material to be equal to the circumferential speed of the drum at the location of the retaining means. At the moment of cutting the wrap will have the same speed as the parts on the drum gripping the wrap, as a result of which the accuracy of the positioning is increased. To that end the second supply means preferably comprise a pair of drive rollers and a servo motor for the driving thereof.

Preferably the device is furthermore provided with means for detecting markings on the web of wrapping material, such as a photocell, means for measuring the web speed, as well as with means for determining the actual distance between the markings based on the data of the detection means—and the measuring means and means for adjusting the drive of the web of wrapping material to the determined actual distance between the markings. In this way it can automatically be ensured that each time a correct length of wrapping material is cut, which is of importance when the wrapping material has been printed.

Preferably the cutting means are positioned stationary, but adjustable in the transport direction of the web. In this way the exact cutting place is known, and it can be adjusted to the wrap length. The cutting place preferably is adjusted at half a wrap length upstream from a radial plane through the drum perpendicular to the transport direction of the web, so that in case of centred pictures on the wraps these pictures end up exactly at the tip of the head of the product.

Preferably the drive of the cutting means is synchronisedly coupled to the drive means for the drum, so that the cutting means run in register with the retaining means etc. on the drum. Preferably an encoder is provided on the cutting means (which then comprise a blade roller) or on the drive means for the drum, and the encoder is coupled to a control unit for mutual adjustment to the control of the driving of the web of wrapping material.

Preferably the device has furthermore been provided with second means for detecting the presence or absence of a product in the retaining means and with control means for controlling the second supply means independent of the data of the second detection means. Thus it is prevented that wraps are taken along in the drum without a product being present for it. In this way failure in the drum is prevented.

Preferably the drum is provided with means for gripping the product head after the product head has been enveloped with a wrap, and with means for rotating the head gripping means during securing the wrap on the product by the securing means, which gripping means have two pairs of opposite arms. By using two pairs of opposite arms various shapes of heads, both round and for instance flat ones, can be gripped in a stable manner. It is possible here to grip the head when rotating, in which in case of unround heads the arms will be more or less self-piloting.

The securing means preferably comprise pairs of heat welding arms that are also part of the enveloping means and form a kind of diaphragm in there, the drum furthermore being provided with means for moving the heat welding arms from a first position in which they define a passage for the product head and a second position in which the wrap is secured by heat welding, the movement means being arranged at the same side of the drum as the rotation means for the gripping means. Compare the known device, where the drive of the heat welding arms is situated at the other side of the drum than the means with which the gripping means are rotated, as a result of which they are easily accessible to dust and grit. In this suggestion according to the invention—that can also be applied independent of the foil supply location—the drive means in question are accessible from the same, preferably the front side, so that maintenance is facilitated.

This arrangement furthermore makes it possible to shield the driving parts in the drum for the gripping means and the heat welding arms in a simple manner from the space where the products are gripped and treated. The shielding for both driving parts may complement each other here. Failures can be avoided in a simple manner.

For facilitating the maintenance it is preferred that the drum is hinged to the frame. The drum can then simply be rotated away from the device, for instance like a door. In the known device the drum has to be almost entirely detached from the device.

It is preferred here that locking means are present for securing the drum to the frame in an operative position, which locking means may comprise a bolt extending through the frame and the drum, or alternatively means that are active on pressure difference (pneumatic or hydraulic) or electromagnetically active means.

In the known devices the heating of the heat welding arms takes place by means of power cables which connect the heat welding arms at the location of its weld locations to permanent connections outside of the arms. It has appeared that after a while said cables subside and have to be replaced, which is difficult job. This leads to regularly recurring and long periods of standstill.

It is a further object of the invention to provide a solution for this. According to the invention this is achieved with the measure—applicable per se—, that the securing means comprise pairs of heat welding arms that are also part of the enveloping means and form a kind of diaphragm in there, the drum furthermore being provided with means for moving the heat welding arms from a first position in which they define a passage for the product head and a second position in which the wrap is secured by heat welding, the heat welding arms being provided with welding heads, that are connected to a power source by means of bendable copper strips.

The copper strips are flexible with a sufficient overlength to withstand very many movements.

Preferably the copper strips are multiple circumferentially bent, as a result of which a large degree of resilience is achieved. In a possible embodiment the conductive strips form torsion springs.

The bendable conductive strips can be conductively connected to conductors that are stationary with the drum, particularly at a location between the strip ends and at the ends are connected to members stationary with the heat welding arms, such as their rotational shafts. In this way an advantageous distribution of the deformation at rotation of the heat welding arms is achieved.

Two bendable conductive strips can be provided for each heat welding arm, which strips have been connected to both the exits of the power source, respectively, the bendable conductive strips preferably being spaced apart in a direction transverse to the movement of the arm, preferably spaced apart in (drum) radial direction, as a result of which sufficient space can be available for bendable strips and for their connections.

Preferably the heat welding arms are positioned rotatable about their own arm shafts, preferably rotatable about spaced apart shafts, that are preferably coupled to each other for simultaneous movement. This may for instance be thus that the shafts of the respective heat welding arms are provided with inter-engaging teeth, one of the shafts being driven, the driven shaft being driven in the drum by means of leverage.

In a simple embodiment several heat welding arms arranged in the circumferential sense of the drum can be attached to the stationary conductors.

Preferably at least one of all heat welding arms is provided with means for measuring the welding temperature at the welding head, which measuring means have been connected to regulating means for the power source for the welding heads for delivering a respective measuring signal. In this way the actual temperature can be followed, and based on that the welding temperature at the welding head can be regulated at the desired, set value. As a result it is prevented that the welding temperature as a precaution (in order to prevent it from being too low) is set higher than actually necessary for the packaging material in question. This also prevents too high a development of heat, which would otherwise mean a considerable strain for the drum and the parts mounted in there, as well as for the supplied foil web.

As measuring means a PT100 element arranged on the heat welding arm could be used.

The measuring means may comprise measuring conductors that have been attached to the stationary conductors in an insulated manner, so that the conductors have a retaining function in there.

Preferably the measuring means are connected to a heat welding arm having the base of a fork-shaped welding head, in which case sufficient material is present for the connection and it is less vulnerable.

In an advantageous and constructively simple and as a result failure-proof embodiment, only one of the pairs of heat welding arms is provided with the measuring means. Thus one measurement, which is characteristic for all pairs of heat welding arms, suffices.

In the known devices the products, particularly lollipops, are supplied to the packaging station by means of a conveyor chain provided with grippers. Due to wear and tear the chain slackens a little, which results in the synchronisation for the gripper of the chain deteriorating. As a result the operation of the grippers will no longer take place at the right moment. The chain is furthermore particularly affected by the confectionary, when the lollipops are packaged.

It is a further object of the invention to improve on this. To that end the supply means furthermore comprise a number of consecutively positioned disks that are consecutively driven oppositely, the disks being provided with receiving spaces for one stick each, and curved edge strips being positioned at the circumference of the disks for retaining the sticks in the receiving spaces.

By using—rigid—transfer disks possible play is prevented, and the necessary maintenance is minimized. In the long run as well the position of the product can be exactly known.

Preferably of each pair of consecutive disks a first disk at the circumference is provided with equal receiving spaces and the accompanying curved edge strip is adjustable with respect to the receiving spaces and a second disk at the circumference is provided with groups of receiving spaces of different sizes and the accompanying curved edge strips are stationary.

Due to the adjustability an exact fit of the stick in the receiving space can be achieved, as a result of which the position in the vertical plane of the stick can be determined. The disks can be built of several disks or one thick disk, so that the sticks are engaged at several locations along their lengths. In this way the stick can be kept horizontal, which is enhanced by the aforementioned adjustment. As a result the sticks can be gripped in the correct manner by the retaining means in the aforementioned packaging station.

Due the alternating placement, consecutively, of adjustable curved edge strip and adjustable disk it is achieved that the sticks will always move according to a fixed line, the reference line, as a result of which the exact location of the stick in the vertical plane will be known.

The second disks can be adjusted in circumferential direction in order to position the receiving space with the correct size. For ease of this adjustment the second disks are preferably provided with indication means for the sizes of the different receiving spaces, which can be formed by calibration holes corresponding to common stick thicknesses.

Preferably the second disks are provided with a circumferential edge having sawteeth, that are preferably oriented in downstream direction.

When using the disks the drive can be kept axially outside of the disks, so that a failure-proof operation is ensured.

The supply means may in the known manner comprise a singling station, in the form of a turning table assembly. The products supplied in bulk are singled there, in order to, in the known device, be discharged to the grippers with the chain.

The known turning table assembly comprises a sorting or spreading disk, which is conical and is surrounded by the edge of the distribution disk, which is positioned vertically below the spreading disk and in which holes have been arranged for receiving the head of the products. In the outer edge the distribution disk has been provided with a slot, through which the stick may extend in horizontal direction, in order to be engaged by the grippers.

During singling the conical spreading disk turns towards the bulk supply, and the distribution disk turns in opposite direction.

The conical spreading disk is rather expensive, and requires higher building height.

From another aspect the application provides an improvement to this, by means of a singling station for products supplied in bulk, comprising a first discharge means for the products in bulk, a turning table assembly placed below it, and a second discharge means for the singled products, the turning table assembly comprising a distribution disk, positioned for rotation of the first discharge means to the second discharge means and in the circumferential area being provided with means for receiving the product heads, as well as a spreading disk placed within the circumferential edge area, that is oppositely driven and has a support surface for the products coming from the first discharge means and discharging them to the circumferential edge area of the distribution disk, the support surface being substantially flat. It has appeared that with a flat support surface a good movement of the products to the distribution disk can be achieved.

Preferably the spreading disk extends with an edge area over the circumferential edge area of the distribution disk. In this way it is prevented that grit or dust originating from the heads of the products or even the sticks of the products ends up in the slit space between both disks. The spreading disk has preferably been sunk into the distribution disk. This measure can also advantageously be applied in conical spreading disks.

Preferably the edge area slopes radially to the outside.

It is noted that the several subjects or elements described above, such as the arrangement of the second supply means, the discharge station, the means for detecting markings and the means connected to them, such as the cutting means, the securing means, the diaphragm means, the measuring means for their temperature, the first supply means, the arrangement of the drum and the singling station, in a packaging machine according to the preamble can be applied separately or in combination, and may constitute an invention per se.

BRIEF DESCRIPTION OF THE DRAWINGS

The invention will be elucidated on the basis of the exemplary embodiment shown in the attached drawings, in which.

DETAILED DESCRIPTION OF THE INVENTION

Figure 1:
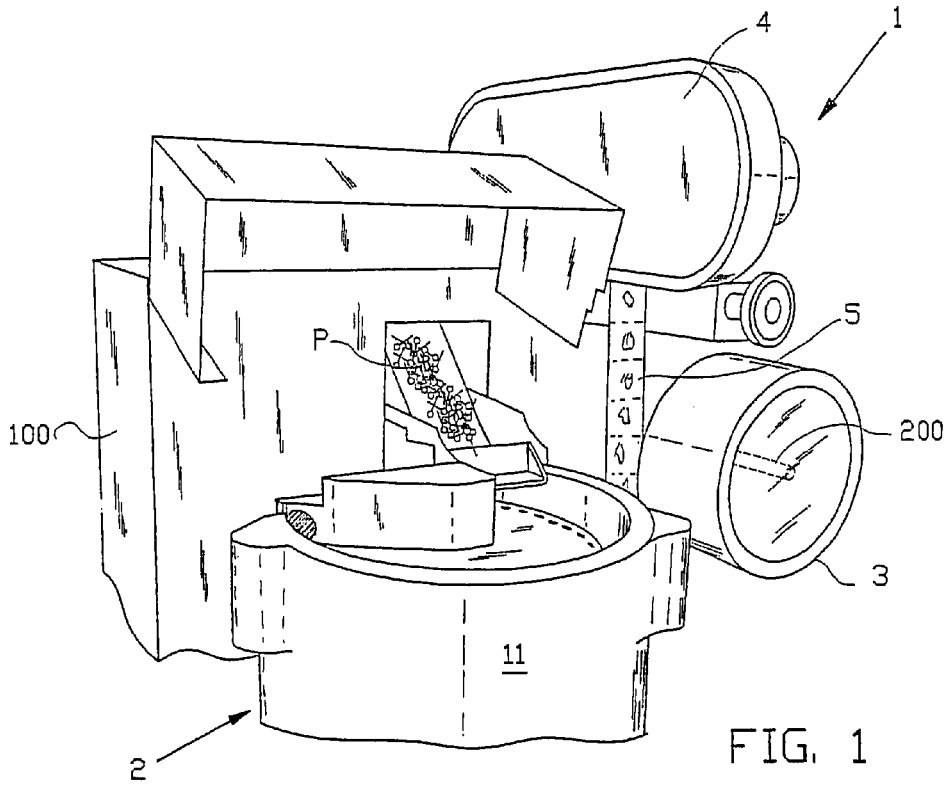
FIG. 1 shows a rough view of a device according to the invention.

The device 1 in FIG. 1 comprises a frame 100 in which among others a supply station 2 for lollipops P a packaging station 3 and a supply 4 for a web of foil 5 have been included.

Figure 1A:
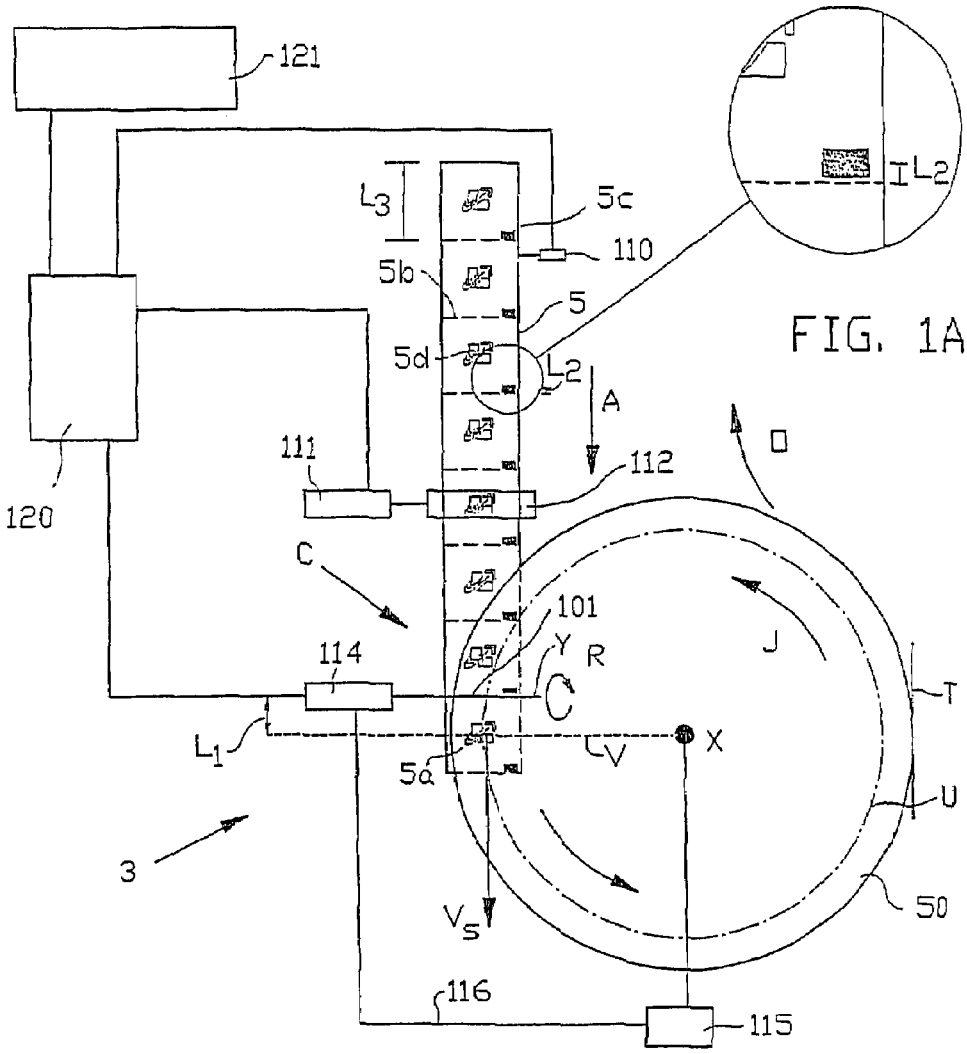
FIG. 1A shows a schematic view of a packaging station of the device according to FIG. 1.

The packaging station 3 has been schematically shown in FIG. 1A, in which it can be seen that the web of wrapping material 5 is supplied in the direction A, downwards to a drum 50, which is driven in the direction B. The web of wrapping material is thus tangentially, according to the tangent, supplied to the drum 50. In a manner that is not further shown, lollipops are supplied in the direction C, in order to come horizontally in line with the leading wrap 5*a*, which has been cut off from the web 5 at the location of blade 101. The head of the lollipop then is situated in the path U, which is also the path of the centre lines of the wrappers and the diaphragm arms, also see FIG. 7.

It can be seen that the web of wrapping material 5 has been provided with markings 5*c*, for each wrap 5*a* to be made. Each prospective wrap has a picture 5*d* in the centre, which picture is intended to end up at the tip of the head of a lollipop. As a result the exact positioning is of great importance.

Between the prospective wraps, desired cutting lines 5*b* have been shown at distance L2 of the marking 5*c*. In the path of the markings 5*c* a photocell 110 has been placed, which delivers its signal to a control unit 120. Connected to the control unit 120 is furthermore, a servo motor 111 driving the drive rollers 112 for the transport in the direction A of the web 5. The servo motor 111 has furthermore been connected to the control unit 120. Downstream of it a rotating blade 101 has been placed, which rotates in the direction R and cuts the web 5 according to line Y. The blade is driven by drive 114, which has been connected via mechanical means 116 to drive 115, with which the drum 50 is driven about centre line X in the direction J. The blade drive 114 has been provided with an encoder, which is connected to the control unit 120. The control unit 120 has furthermore been connected to an operation panel 121, in which data such as the desired wrap length L3 and the position of the cutting line 5*b* with respect to the markings 5*c*, with L2 can be entered.

By entered length L2, the wanted location of the cutting line 5*b* with respect to the print 5*d* is determined.

In operation the distance L1 of the line Y with respect to the imaginary line V that is transverse to the direction A and intersects the centre line X of the drum 50, is set, by setting the drive 114 and the blade 101 at a distance L1 of ½ L3 above it. The mechanical drive connection 116 has been adapted to make that adjustment possible, the drive 115 for the drum 50 remaining in its place. This may for instance be done by incorporating a cardan connection in the connection 116.

The servo motor 111 is driven by the control unit 120 in order let the drive rollers 112 rotate at a correct speed.

It may be that the length L3 differs from the actual length. The photocell 110 will then detect a marking 5*c* at a deviant moment, based on which detection the control unit 120 will drive the servo motor 111 to let the drive rollers 112 pass an altered web length.

The drive of the web 5 takes place at such a speed, that at the moment of cutting, the web has the same speed V.sub.s as the circulation speed in the path U of the drum T. For determining the position and speed of the drum and thus the parts situated in there, the encoder at the drive 114 is used.

When no product is supplied this is detected by a photocell (not shown) placed near the drum 50, which photocell then delivers a signal to the control unit 120, which then immediately stops the servo motor 111. As a result no foil material is wasted.

After wrapping, the packaged lollipops are discharged at the top of the drum 50, according to arrow O. This will be further gone into.

In the FIGS. 2 and 3A-D the distribution station 2 is further shown. The distribution station 2 comprises a feed chute 13 for the lollipops P, which chute 13 starts at a hopper or the like. The distribution station 2 comprises a screen 11, within which a disk assembly 6 is rotatable about a vertical centre line. The disk assembly 6 comprises a distribution disk 7 driven in the direction E and a sorting disk 8 situated within it and driven in the direction D.

Figure 3D:
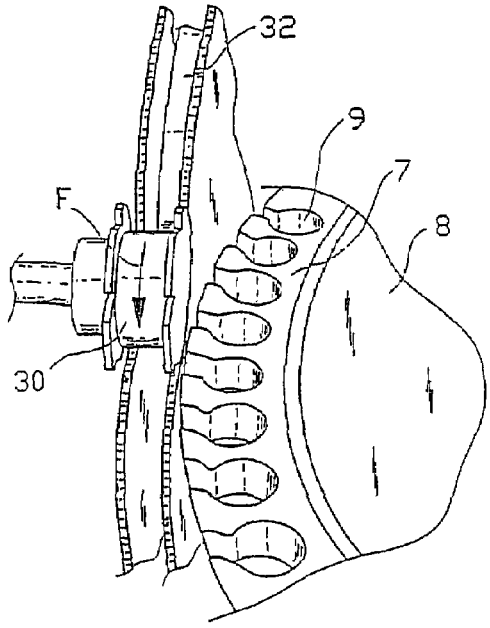
FIG. 3A-D shows a cross-section and details of the distribution station of FIG. 2.
Figure 3A:
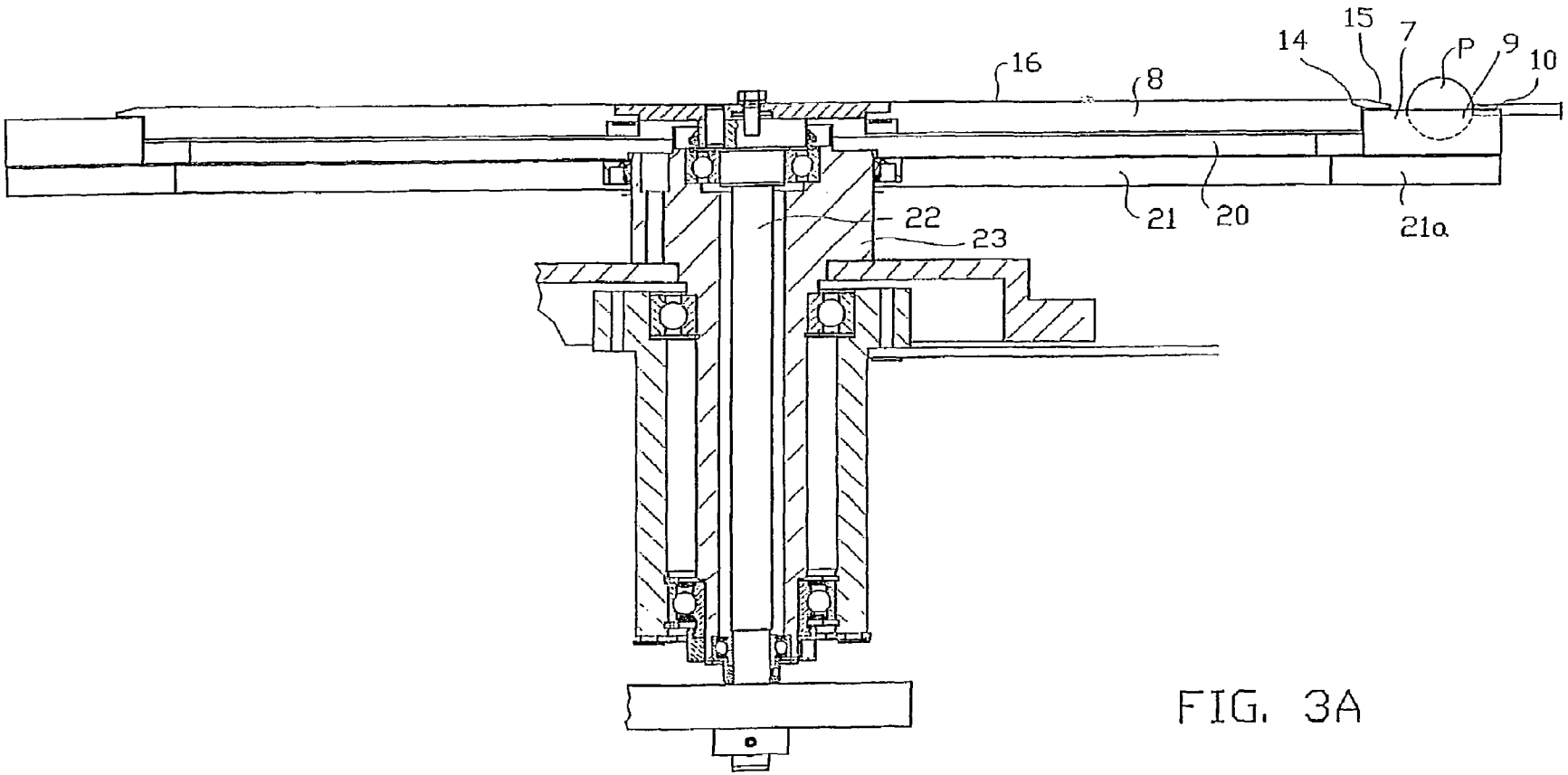
Figure 3B:
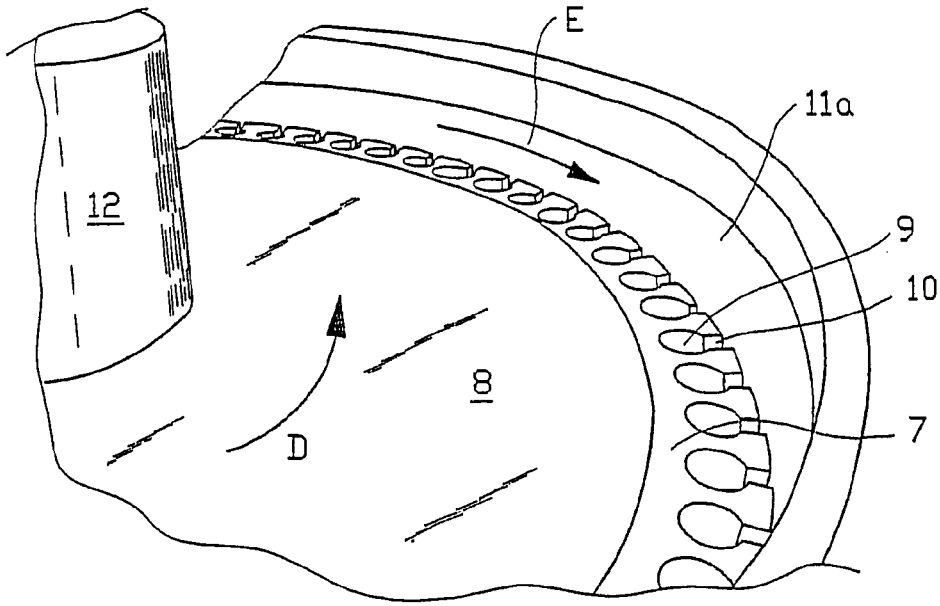

As can be seen in FIGS. 3A and 3B the distribution disk 7 has holes 9 at the circumference, having slots 10 extending radially to the outside. The distribution disk 7 is raised at the edge, and changes radially to the inside into a plate 20, which is attached for rotation on a hollow shaft 23. Within the hollow shaft 23 there is shaft 22, which is attached for rotation to the sorting disk 8. The sorting disk 8 has a flat upper surface 16, and has, as it were, been let into the distribution disk 7. With an edge nose 14 having an inclined surface 15 the sorting disk 8 extends slightly over the edge of the distribution disk 7. The sorting disk 8 is made of a suitable food-compatible synthetic material. As a result the noise production when the lollipops fall down is strongly reduced.

Below the distribution disk 7/20 there is a stationary disk 21. The edge area 21*a* ensures that the lollipops cannot fall down out of the holes 9.

In FIG. 3B it is shown that in the first area of the distribution the distribution disk 7 is limited at the outer side by an inclined wall 11*a*, as a result of which sticks of lollipops already received in the holes have a freedom of tilting to the outside, as a result of which the degree of occupation of the sticks in the areas situated more radially to the inside is less. This is advantageous for the distribution and thus for the degree of filling the distribution disk 7.

Figure 2:
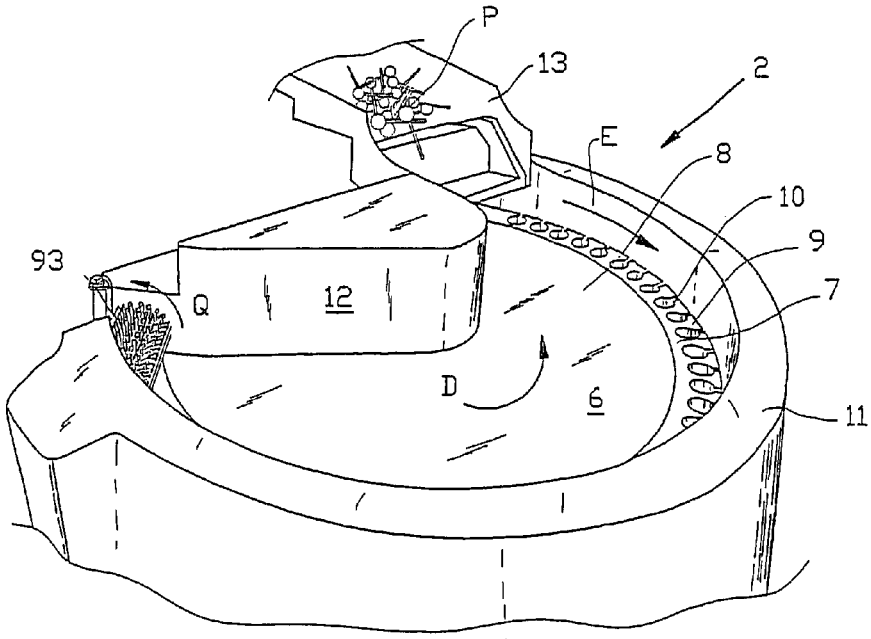
FIG. 2 shows a schematic view of the distribution station of the device of FIG. 1.

As can be seen in FIG. 2, a partition 12 has been positioned above the sorting disk 8, which partition connects the feed chute 13. At the left side there is a brush 93, which is rotated in the direction Q, in order to as yet correctly orient sticks that may not yet extend horizontally through the slits 10.

Figure 3C:
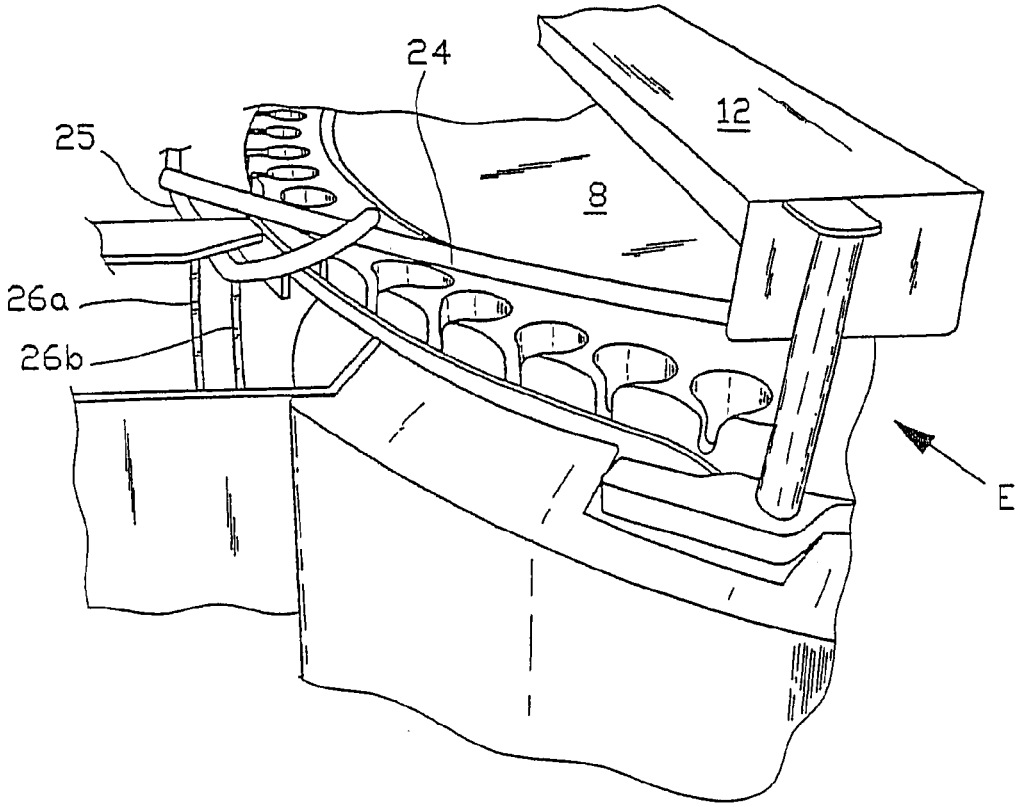

Downstream of the brush 13, as can be seen in FIGS. 3C and 3D, there is an area where the lollipops have been singled, and have been received with their heads in the holes 10, and extend horizontally with their sticks, the guides 24 and 25 being helpful. The guides 25 and 26 ensure the horizontal orientation of the sticks of the lollipops P.

Figure 4:
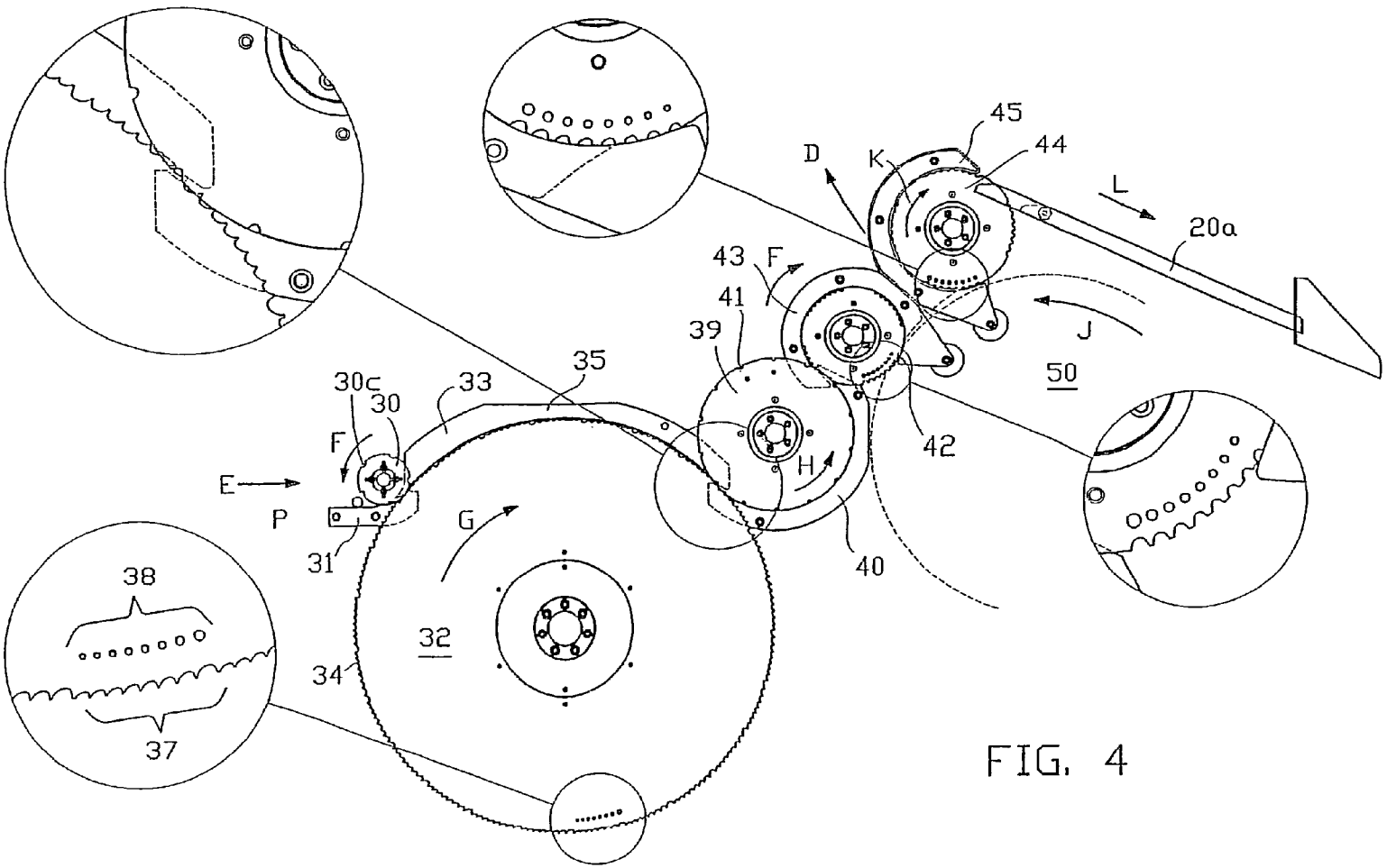
FIG. 4 shows a schematic view of the means for transferring products from the distribution station to the packaging station in the device of FIG. 1 as well as discharge means from the packaging station.

The sticks are then well aligned to be transferred by first pair of transfer disks 30, that are rotated in the direction F. The pair of transfer disks 30 form the start of a series of transfer disks, depicted in FIG. 4. It is noted that here there are always pairs of disks, arranged on the same drive shaft, the drive being axial at a distance from the disks.

The supply direction E of the lollipops from the distribution station 2 has been schematically shown.

The disks 30 are driven in the direction F. The stick of the product P is supported by stationary curved edge strip 31, to retain the sticks in the notches 30*c* of the disk 30, during rotation.

Downstream of the disks 30, disks 32 have been positioned, which are rotatable in the direction G. At their circumferential edge the disks 32 have been provided with sawtooth-shaped notches 34, the tip standing slightly in the direction of movement. The sawteeth form groups 37, of varying depth. In the group 37 a series of holes 38 has been made in the disk 32, which correspond to the dimensions of the recesses in the group 37 formed by the teeth.

Above the disks 32 there is a stationary curved edge strip 33, having a retaining edge 35.

Downstream of the disks 32 a pair of disks 39 is positioned, which is comparable to the pair of disks 30, and is rotatable in the direction H. The disks 39 have been provided with receiving spaces 41, that are equal in size. Below the disks 39 a curved edge strip 40 has been positioned.

Downstream of the disk 39 disks 42 have been positioned, which correspond to the disks 32, though have a small diameter. The disks 42 are rotated in the direction I, and are surrounded by a stationary curved edge strip 43.

Note that the diameter of the disks 32, 39 and 42 decreases.

The drum 50 of the packaging station, rotated in the direction J is schematically shown. The grippers situated behind the drum 50, which are not shown either, and which rotate along with the drum 50 receive the lollipops from the disks 42.

As seen in the drawing on the right, above the disks 42 a comparable pair of disks 44 has been positioned, which receive the packaged lollipops from the packaging station. The disk 44 rotate in the direction K, and have also been provided with sawteeth of different lengths. Here as well a stationary curved edge strip 45 has been positioned. The lollipops are discharged from the disks 44 in the direction L, for discharge on discharge chute 200, which is adjustable. Possibly further disks may be provided, for bringing the lollipops to a higher level, to expand the sorting possibilities.

Particular is that the curved edge strips 31 and 40 can be adjusted with respect to the centre line of the disks 30 and 39 in radial direction. The bottom of the holes 30*c* is always fixed, and forms a reference. The motion of this bottom forms a reference line. Said reference line is continued on the edge 35 of the stationary curved edge strip 33, and on the bottom of the receiving spaces 41 of the disk 39, and subsequently on the edge of the stationary curved edge strip 43. The adaptation to the stick thickness takes place by selecting the correct teeth depth of the teeth group 37, in which the holes 39 form an aid. The receiving space, with the correct depth comes to lie opposite the receiving space 30*c* or 41.

Figure 5B:
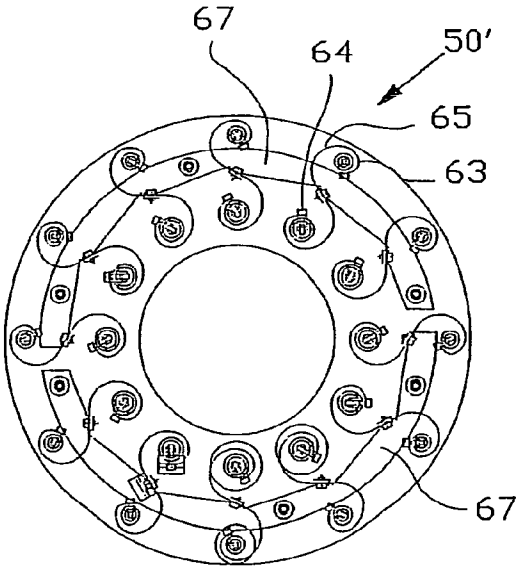
FIG. 5A-C show the diaphragm means separately, an arrangement of the conductors for the diaphragm means of FIG. 5 and a separate conductor, respectively.
Figure 5C:
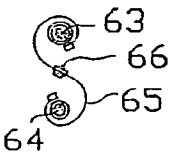
Figure 5:
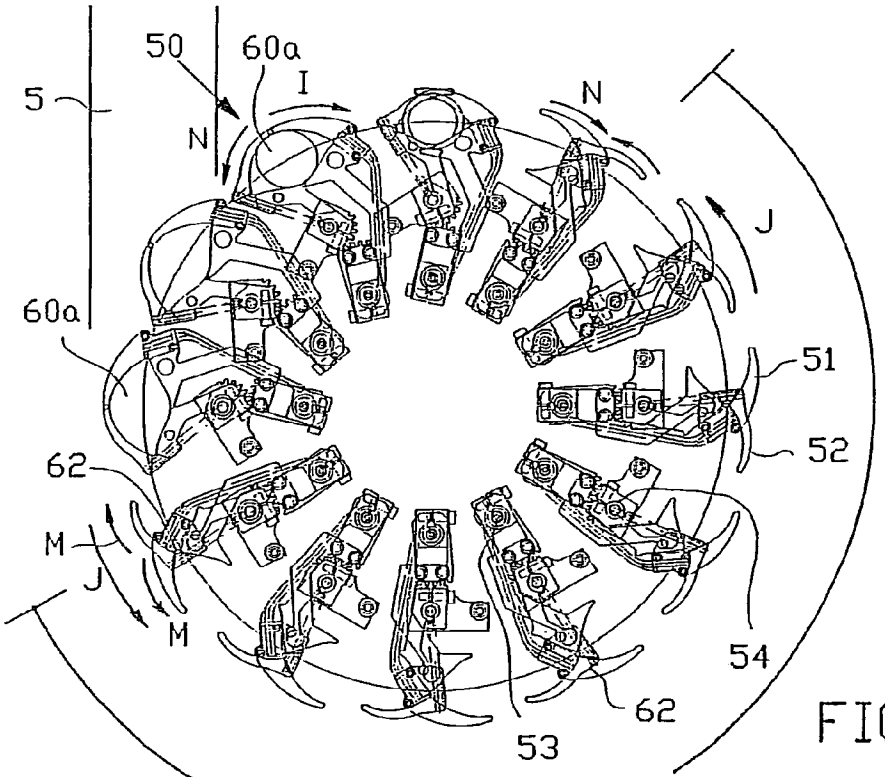
FIG. 5 shows a view of the diaphragm means in the packaging station.
Figure 5A:
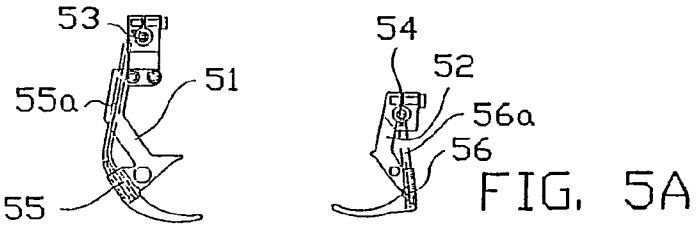

FIG. 5 schematically corresponds to FIG. 1A in which the web of wrapping material 5 is shown again. A part of the drum 50 has now been shown, namely the diaphragm means and the means for welding the wrap. A series of pairs of arms 51, 52 (also see FIG. 5A) has been arranged on the drum 50, which arms are attached in a rotary-fixed manner to the ends of shafts 53 and 54, respectively, that are rotatably attached to the drum 50. With means that are yet to be discussed, the arms 51 and 52 are rotated at the correct moment.

Presently, referring to the FIGS. 5A-C and 6A,B the embodiment of the arms 51, 52 and their attachment will first be gone into further.

Figure 7:
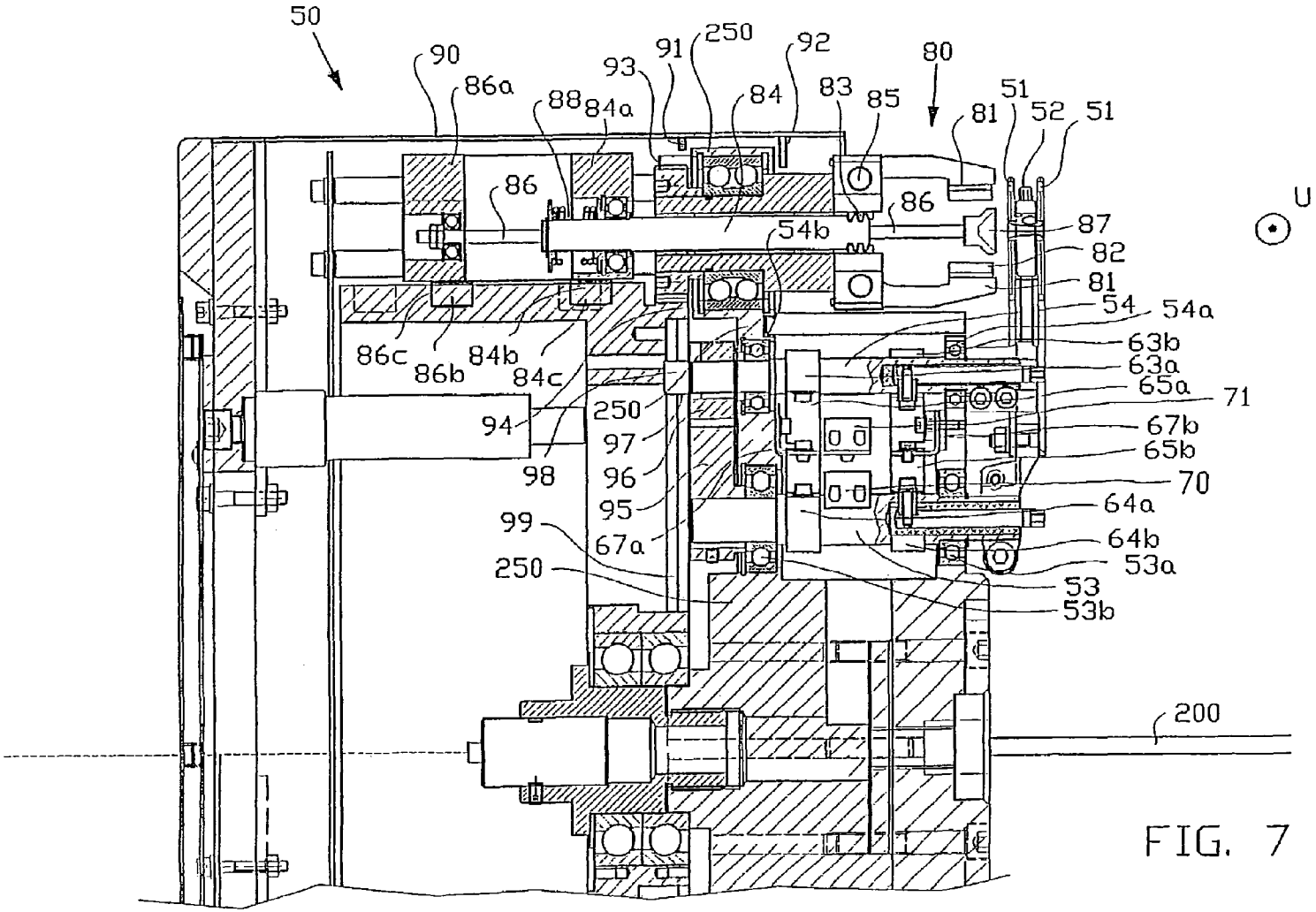
FIG. 7 shows a cross-section of a head retainer and a rotator with a schematically shown diaphragm.

Because the shaft 53 lies radially within the shaft 54, the arm 51 is longer than the arm 52. The shaft 53 is bearing mounted in bearings 53*a,b* and the shaft 54 in bearings 54*a,b*. At the end facing away from the arms 51, 52, an arm 95 provided with teeth 95*a* has been attached on shaft 53 and a part 96 provided with teeth 96*a* inter-engaging therewith on shaft 54, which part 96 furthermore comprises a lever 97 extending radially from the shaft 54. At the free end of the lever 97 a cam roller 98 (FIG. 7) can be attached, which circulates in a cam track 99 (FIG. 7).

The ends 63*a,b* and 64*a,b* of copper strips 65*a,b* that have been helically bent twice and in an opposite manner, have been attached on the shafts 53, 54 between both ends thereof. Due to the multiple circulating bent shape (FIGS. 5B,C) the copper strips 65 have a large actual length, so that they are active as so-called rotation springs and are able to cater for multiple rotation between their ends without a problem. Due to their bent shape they are able to follow the reciprocating movement of the shafts 53 and 54 and the arms 51 and 52 easily and without adverse tensions. As a result a reliable operation is realised for a long time.

Figure 6A:
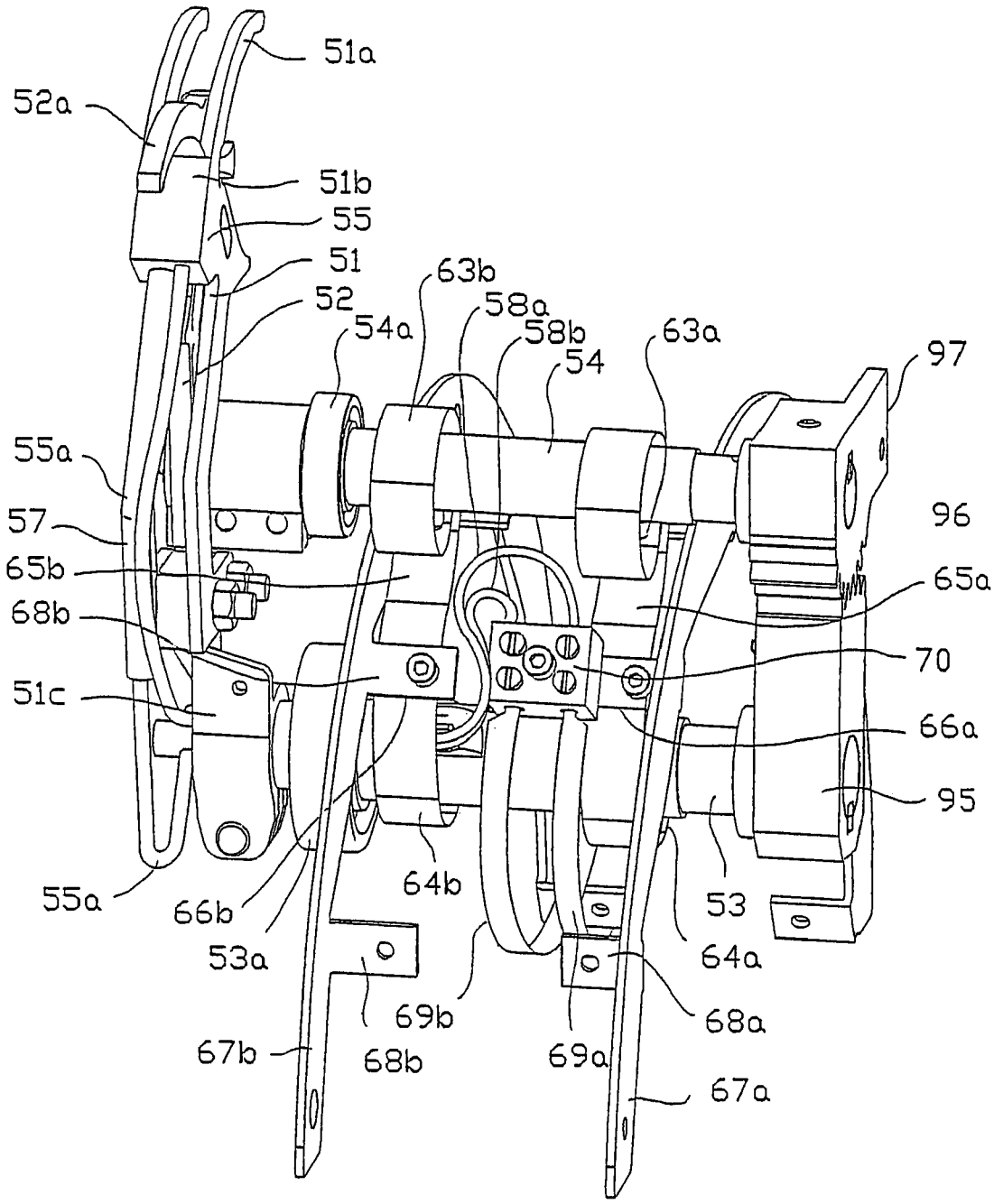
FIG. 6A-C show a view in perspective, a cross-section and an end view, respectively, of the diaphragm means.

The copper strips 65*a,b* are S-shaped and in their middle 66 attached to turned lips 68*a,b* of mounting strips 67*a,b*, which have been attached to the drum for rotating along with it. The mounting strips 67*a,b* are also of power conducting material and connected to both outputs of a power source (not shown). In FIG. 6A it can be seen that the mounting strip 67*a,b* is provided with several lips 68*a,b* for mounting several diaphragms, for instance six.

The arm 51 has a fork-shaped end 51*a* having a base 51*b*, and with the other end 51*c* has been attached on the shaft 53. The arm 52 has a one-part end 52*a*, which at rotation of the arms 51, 52 is able to move into the fork 51*a* and out of it again.

Figure 6B:
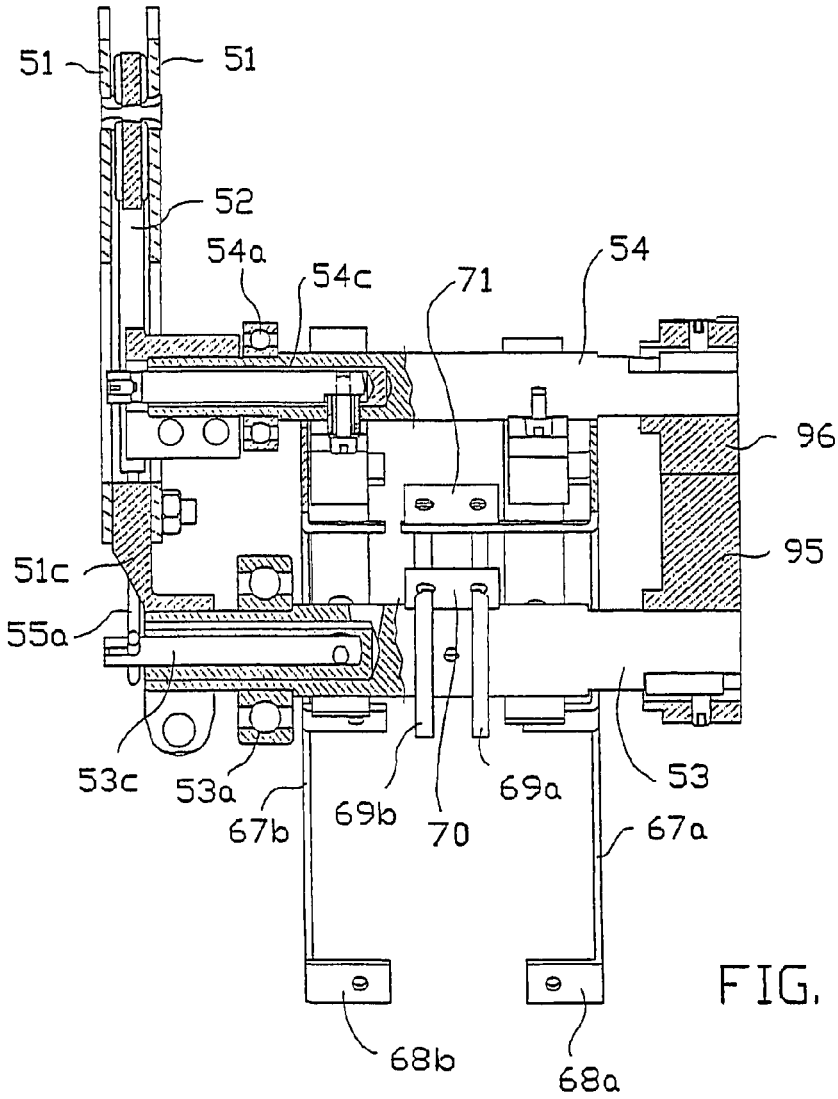
Figure 6C:
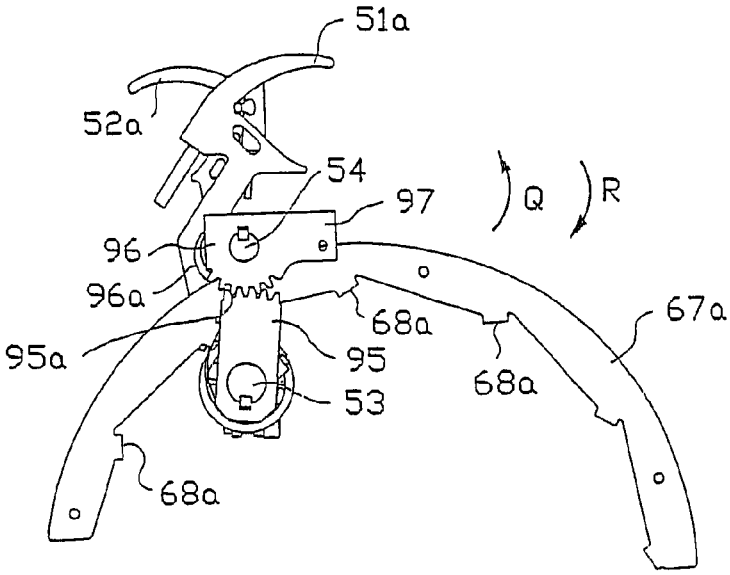

The arms 51 and 52 have respectively been provided with heaters 55, 56 that have been attached in ends 51*a*, 52*a*, in the arm 51 at the fork base 51*b*. The power line 55*a* running along the arm 51, is rigid and connects via a shaft member 53*c* (FIG. 6B), which is accommodated in the shaft 53, insulated with respect to the rest of shaft 53, in a power conducting manner to the end 64*b* of the copper strip 65*b*. The arm 51 of the power conducting material is itself connected in a power conducting manner via end 51*c* and via the shaft 53 to the end 64*a* of the copper strip 65*a*. In a comparable manner the arm 52 and the (rigid) power line 56*a* for the heater 56 are parallel connected to the ends 63 and 63*b* of the copper strips 65*a* and 65*b*, respectively.

One of the diaphragms, shown in FIG. 6A (and FIG. 7), has been provided with means for measuring the temperature of the end 51*a* of the arm 51. To that end a PT 100 element 57 has been connected to the fork base 51*b*, which element by means of wires 58*a,b* guided along the shaft 53 is connected to a first connector 70. Said connector 70 is as it were floatingly connected to the first ends of two copper spring strips 69*a,b* which with their second ends have been attached in a second connector 71 (FIG. 7), which in an insulated manner is fixedly attached to a lip 68*a* of mounting strip 67*a*. From there separate wires, that are not shown, lead to means for reading the measurement data and for controlling the heating means based on those measurement data.

FIG. 5 indicates the position of the arms 51 and 52 one to the other during a full revolution of the drum 50. Where a web of wrapping material 5 is cut, the arms 51 and 52 are moved farthest from each other, in order to define an opening 60*a*, through which cut off wrap and the head of a lollipop can be pressed.

Immediately after that the arms 51, 52 are moved towards each other in the directions M in order to clamp the stick of the lollipop rotatably in between them, as well as the edge areas of the wrap. In the track P the heating means 55, 56 are then activated, which is a relatively long track, so that the temperature can be kept relatively low, for instance 200.degree. C. in stead of the usual 230-240.degree. C. This in turn has positive effects on the total heat development, as a result of which the surroundings of the drum are burdened less with heat. This in turn has positive effects on the total heat development, as a result of which the surroundings of the drum are burdened less with heat, and when starting the machine the web of foil material already pendent will not or hardly deform.

At the end of the track P the arms 51 and 52 are operated to turn away from each other in the direction N. Opening 60 is then also formed by the arms 51, 52 which is large enough for retracting the head of the lollipop that has now been provided with a wrap. This takes place by axial sliding of the retainers. The arms 51, 52 are now free again for a next cycle.

In FIG. 7 the arms 51 and 52 are again shown, wherein the relative position of the wrappers 80 with respect to them is also shown, which wrappers 80 have been positioned with each pair of arms 51, 52, and rotate along with them. As can be seen in FIG. 7 the means for driving the arms 51, 52 are situated at the same side as the means for driving the wrappers 80. The wrappers 80 comprise arms 81, only two of which have been shown, but it should be understood that a same pair of arms is at 90.degree. and therefore is situated above and below the plane of the drawing. The arms 81 have been provided with gripping surfaces 82, for good grip on the wrapped head of the lollipop. At the location of 85 the arms are hinging, and designed as a lever, having teeth 83 at the other end. Said teeth 83 are in engagement with teeth on a reciprocating pin 84.

When the head with wrap has been passed through the diaphragm arms 51, 52, the pin 84 is moved to the right, as a result of which the arms 81 tilt towards each other, until the wrap on the head is engaged by the surfaces 82. The drive of the wrappers 80 takes place by inter-engagement of teeth 93 onto teeth of stationary toothed wheel 94, so that the wrappers rotate about their own centre lines during the entire revolution of the drum 50 about drum centre line X. The drive of the tilting movement of the arms takes place by the movement of the cam roller 98 in the cam track 99. Due to movement of the roller 98 to the outside, the lever 97 will swing in the direction Q, as a result of which the member 96 is rotated and thus the shaft 54 and thus the arm 52. Due to inter-engagement of the teeth 96*a* and 95*a* the lever 95 will also rotate, but oppositely. In this way the shaft 53 rotates and thus the arm 51, in which the arms 51 and 52 rotate towards each other. When the cam roller moves inwards the arms 51 and 52 are moved apart again. Due to suitable design of the cam track 99 the desired motion of the arms 51 and 52 will take place at the desired locations in the revolution of the drum.

An ejector 86 is also guided through the pin 84, which ejector with respect to it is reciprocally slidable and in the shown position with the smooth end 87 (which is replaceable and adapted to the shape of the head of the product) positioned for contact with the wrap and the head, when the wrap is cut off and passed through the diaphragm arms 51, 52 with the head. At the end, the pin 84 is attached by means of a spring 88 to reciprocally moveable block 84*a*, to which a cam 84*b* has been attached, which runs in a circumferential cam track 86*c*. At the end the ejector 86 has been attached to reciprocally moveable block 86*a*, to which a cam 86*b* has been attached, which runs in a circumferential cam track 86*c*.

Due to the spring 88 the pin 84, when it has been urged by the cam 84*b* to the right in the cam track 84*c* and the wrapper arms 81 have been brought to a closing position, is urged further to the left to further bias the wrapper arms 81 against the lollipop, as long as the wrappers 80 are active. The pin 86 rotates along with the wrappers 80.

After wrapping and opening the wrapper arms 81, as well as opening the arms 51 and 52, the pin 86 will move again to the left, together with the retraction of the retainer that is not shown here.

The drum 50 has been surrounded by a stationary casing 90, which at the inside has been provided with circumferential partitions 91 and 92 that extend radially to the inside, which partitions together with the casing 90 and the nearby wrappers 80 form a labyrinth for screening the driving parts against dust and sugary particles. Said screening is furthermore realised of its own accord by the parts that are situated between the wrappers and the heat welding arms on the one hand and the driving parts thereof on the other hand, in particular also by the plate 250, which rotates along and in which holes have been made for the several bearings. A further advantage of this arrangement is that the axial build-in length can be small.

The drum 50 is attached to the frame with a hinge having a vertical centre line (T in FIG. 1A), and locked by means of a bolt 200 extending through the frame.

The invention claimed is:

1. A device for packaging products having a head and a stick, in wraps, comprising a frame including first supply means for supplying the products, second means for supplying a web of wrapping material, means for cutting a wrap from the web, a wrapping station having a driven series of means for retaining the products circulating in a first direction about a horizontal shaft, and a drum driven in the same direction having means for enveloping the product heads with a wrap and means for securing the wrap on the products, the securing means comprising pairs of heat welding arms, that are also part of the enveloping means and forming a kind of diaphragm in there, the drum furthermore being provided with means for moving the heat welding arms between a first position in which they define a passage for the product head and a second position in which the wrap is secured by heat welding, the heat welding arms being provided with welding heads that are connected to a power source by means of bendable strips of conductive material, wherein the conductive strips being conductively connected to conductors that are fixed to the drum, at a location between the strip ends and the strips being connected at the ends to parts that are fixed to the heat welding arms.

2. The device according to claim 1, the conductive strips being multiple circumferentially bent.

3. A device for packaging products having a head and a stick, in wraps, comprising a frame including a first supply means for suplying the products, second means for supplying a web of wrapping material, means for cutting a wrap from the web, a wrapping station having a driven series of means for retaining the products circulating in a first direction about a horizontal shaft, and a drum driven in the same direction having means for enveloping the product heads with a wrap and means for securing the wrap on the products, the securing means comprising pairs of heat welding arms, that are also part of the enveloping means and forming a kind og diaphragm in there, the drum furthermore being provided with means for moving the heat welding arms between a first position in which they define a passage for the product head and a second position in which the wrap is secured by heat welding, the heat welding arms being provided with welding heads that are connected to a power source by means of bendable strips of conductive material, wherein two bendable conductive strips being provided for each heat welding arm, which strips have been connected to both the exits of the power source, respectively, the bendable conductive strips being spaced apart in a direction transverse to the movement of the arm.

4. The device according to claim 3, two bendable conductive strips being provided for each heat welding arm, which strips have been connected to both the exits of the power source, respectively, the bendable conductive strips being spaced apart in a direction transverse to the movement of the arm, several heat welding arms arranged in the circumferential sense of the drum being attached to the stationary conductors.

5. The device according to claim 3, the conductive strips being multiple circumferentially bent.

6. A device for packaging products having a head and a stick, in wraps, comprising a frame including a first supply means for suplying the products, second means for supplying a web of wrapping material, means for cutting a wrap from the web, a wrapping station having a driven series of means for retaining the products circulating in a first direction about a horizontal shaft, and a drum driven in the same direction having means for enveloping the product heads with a wrap and means for securing the wrap on the products, the securing means comprising pairs of heat welding arms, that are also part of the enveloping means and forming a kind og diaphragm in there, the drum furthermore being provided with means for moving the heat welding arms between a first position in which they define a passage for the product head and a second position in which the wrap is secured by heat welding, the heat welding arms being provided with welding heads that are connected to a power source by means of bendable strips of conductive material, the heat welding arms being positioned rotatable about their own arms shafts, both heat welding arms being rotatable about spaced apart shafts, spaced apart at radial distance, both heat welding arms preferably being coupled to each other for simultaneous movement.

7. The device according to claim 6, the shafts of the respective heat welding arms being provided with inter-engaging teeth, one of the shafts being driven, the driven shaft being driven in the drum by means of leverage.

8. The device according to claim 6, the conductive strips being multiple circumferentially bent.

9. A device for packaging products having a head and a stick, in wraps, comprising a frame including a first supply means for suplying the products, second means for supplying a web of wrapping material, means for cutting a wrap from the web, a wrapping station having a driven series of means for retaining the products circulating in a first direction about a horizontal shaft, and a drum driven in the same direction having means for enveloping the product heads with a wrap and means for securing the wrap on the products, the securing means comprising pairs of heat welding arms, that are also part of the enveloping means and forming a kind og diaphragm in there, the drum furthermore being provided with means for moving the heat welding arms between a first position in which they define a passage for the product head and a second position in which the wrap is secured by heat welding, the heat welding arms being provided with welding heads that are connected to a power source by means of bendable strips of conductive material, wherein at least one of all heat welding arms being provided with means for measuring the welding temperature at the welding head, which measuring means have been connected to adjustment means for the power source for the welding heads for transmitting a respective measuring signal, the measuring means comprising a PT100 element on the heat welding arm.

10. The device according to claim 9, two bendable conductive strips being provided for each heat welding arm, which strips have been connected to both the exits of the power source, respectively, the bendable conductive strips being spaced apart in a direction transverse to the movement of the arm, the measuring means comprising measuring conductors that have been attached to the stationary conductors.

11. The device according to claim 9, the measuring means being connected to a heat welding arm with the base of a fork-shaped welding head.

12. The device according to claim 9, of a pair of heat welding arms only one of the arms being provided with the measuring means.

13. The device according to claim 9, only one of the pairs of heat welding arms being provided with the measuring means.

14. The device according to claim 9, the conductive strips being multiple circumferentially bent.

* * * * *